US006595715B1

(12) United States Patent
Cortell

(10) Patent No.: US 6,595,715 B1
(45) Date of Patent: Jul. 22, 2003

(54) GUIDERAIL POST

(76) Inventor: Dominick J. Cortell, 1351 Meadowood Cir., Poland, OH (US) 44514

( * ) Notice: Subject to any disclaimer, the term of this patent is extended or adjusted under 35 U.S.C. 154(b) by 0 days.

(21) Appl. No.: 10/101,118

(22) Filed: Mar. 20, 2002

(51) Int. Cl.[7] ..... E01F 15/00
(52) U.S. Cl. ..... 404/6; 404/9; 256/13.1
(58) Field of Search ..... 404/6, 9, 10, 12; 256/1, 13.1

(56) References Cited

U.S. PATENT DOCUMENTS

| | | | | | |
|---|---|---|---|---|---|
| RE18,848 | E | * | 5/1933 | Moore | 404/6 |
| 4,138,095 | A | * | 2/1979 | Humphrey | 256/1 |
| 5,044,609 | A | * | 9/1991 | Cicinnati et al. | 256/13.1 |
| 5,219,241 | A | | 6/1993 | Picton | |
| 5,507,473 | A | | 4/1996 | Hammer et al. | |
| 5,657,966 | A | | 8/1997 | Cicinnati | |
| 6,007,269 | A | | 12/1999 | Marinelli | |
| 6,220,575 | B1 | * | 4/2001 | Lindsay et al. | 256/13.1 |

FOREIGN PATENT DOCUMENTS

| | | | | | |
|---|---|---|---|---|---|
| EP | 1061179 | A1 | * | 6/1999 | E01F/15/04 |
| EP | 0999310 | A1 | * | 11/1999 | E01F/15/04 |
| WO | WO 02/029162 | A1 | * | 4/2002 | E01F/15/14 |

* cited by examiner

*Primary Examiner*—Thomas B. Will
*Assistant Examiner*—Alexandra K. Pechhold
(74) *Attorney, Agent, or Firm*—Harpman & Harpman

(57) ABSTRACT

An integral one-piece metallic guiderail post comprising a contoured leg portion and vertically offset upper end portion onto which a guiderail can be selectively secured. The contoured upper end portion has a vertically oriented rail-mounting surface with an angularly inclined front surface extending therefrom. Elongated support flanges extend from the contoured leg and vertically offset portions in spaced parallel relation to one another. The vertical offset rail engagement portion partially overlies the leg portion effectively transferring vertical impact load on the vertical offset rail portion to the leg portion for ground mounting engagement.

7 Claims, 6 Drawing Sheets

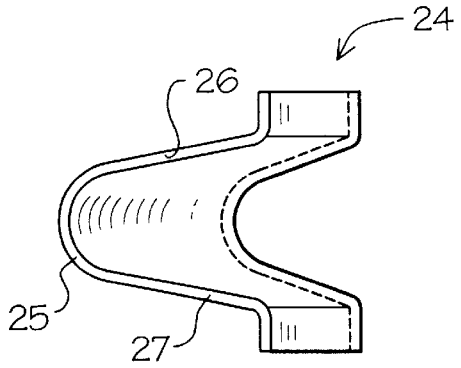
FIG. 6
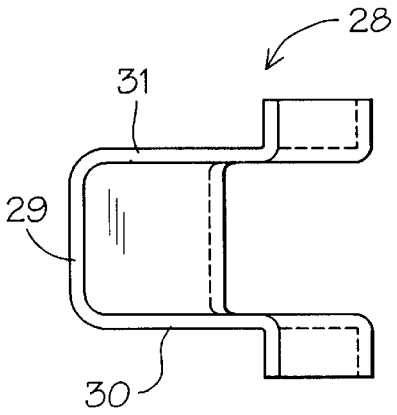
FIG. 7
FIG. 8
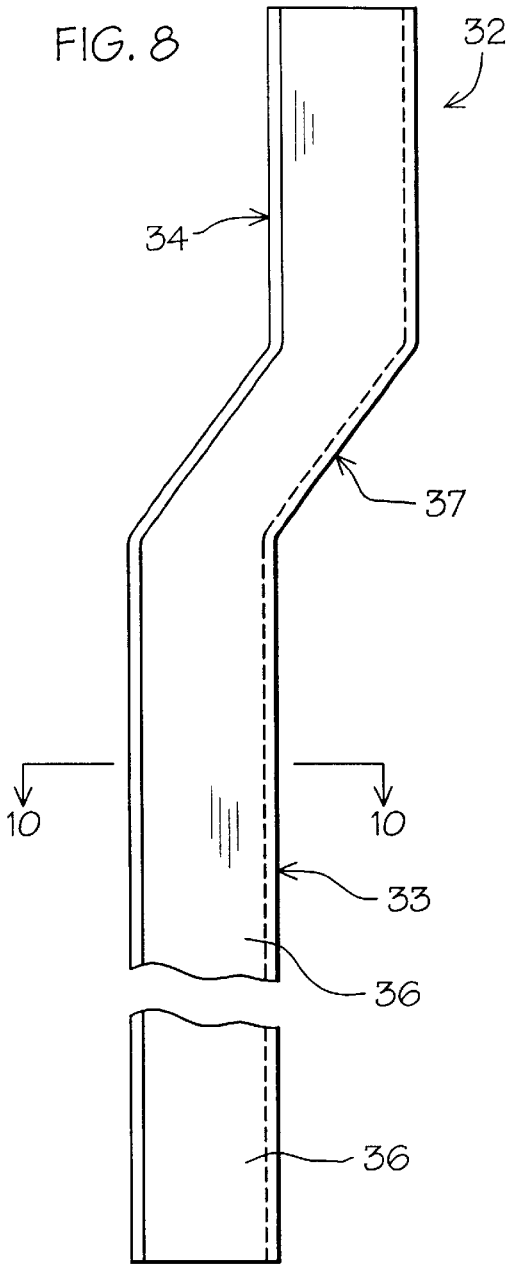

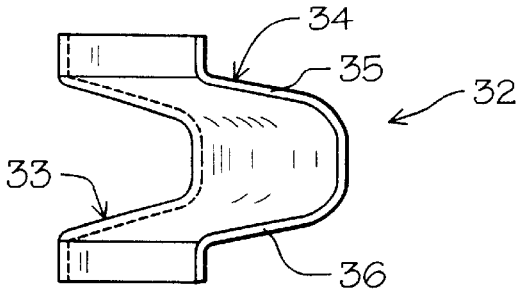
FIG. 9
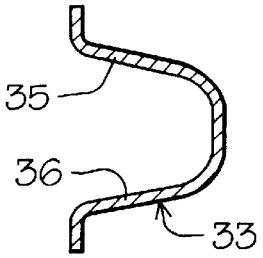
FIG. 10
FIG. 11
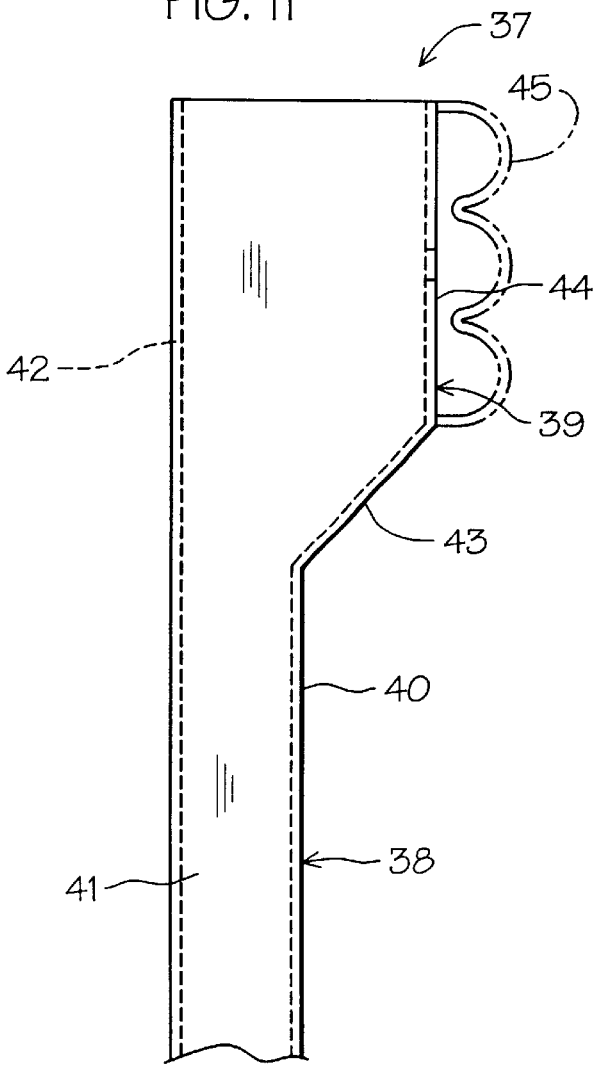

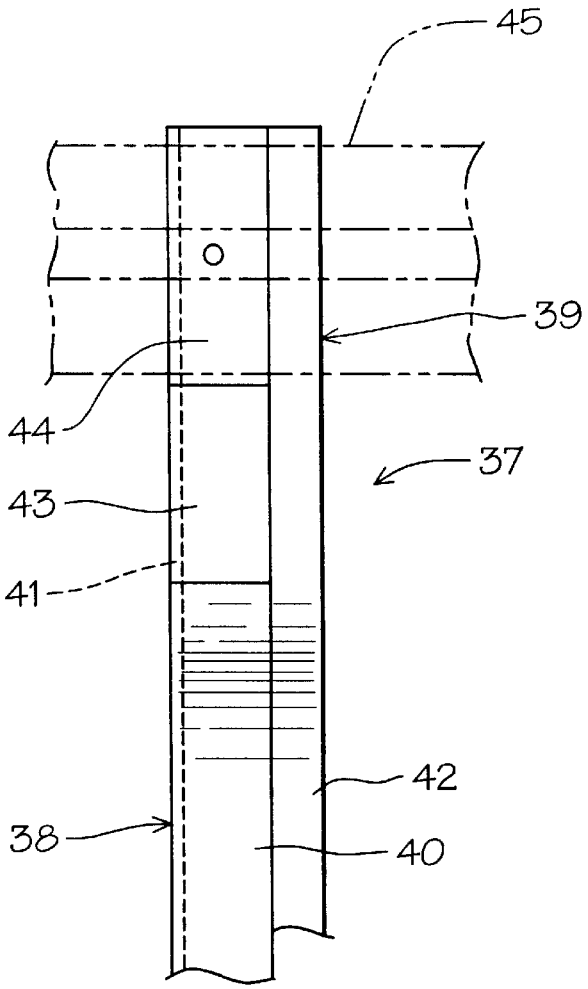
FIG. 12
FIG. 13
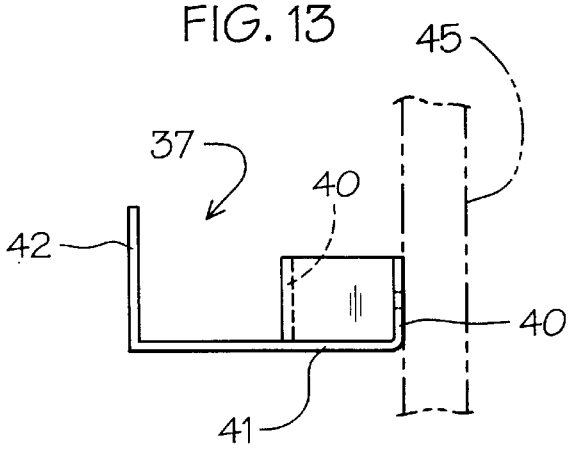

GUIDERAIL POST

BACKGROUND OF THE INVENTION

1. Technical Field

This invention is directed to roadway guiderails that are provided along the shoulders of the highway and as barriers between divided highways and around obstacles such as bridge abutments and the like. Such guiderails are supported by a plurality of longitudinally spaced vertically oriented posts driven or buried into the ground. Such guiderails prevent vehicles from leaving the roadway or crossing over into oncoming traffic.

2. Description of Prior Art

Prior art guiderail barriers are comprises of elongated horizontally extending rails that are mounted on vertically upstanding support posts. Such posts are typically made of wood or steel with offset mounting blocks of wood or synthetic resin material which space the rail in relation to the post at their upper end to which the guiderail is secured. The spacer blocks meet the requirement that the guiderail must be spaced from the support post so that under impact of a vehicle the rail is engaged first, absorbing and deflecting the impact forces imparted thereon. Such spacer blocks have a number of inherent disadvantages including the requirement of a separate mounting step and hardware to secure the block to the post before the guiderail can be secured thereto. Examples of guiderail support posts configurations attempting to eliminate the spacer blocks can be seen in U.S. Pat. Nos. 5,219,241, 5,507,473, and 5,657,966.

In U.S. Pat. No. 5,219,241 a crash barrier post is disclosed having a molded synthetic resin configuration combining a vertical post with an integral spacer block portion. The post is preferably of a solid construction with a rail conforming attached surface extending therefrom.

U.S. Pat. No. 5,507,473 is directed to a one-piece L-shaped guiderail post formed of plastic recyclable material which is reinforced with interior vertical and horizontal metal members.

U.S. Pat. No. 5,657,966 discloses a metallic guiderail barrier having an upstanding post with an apertured spacing bracket extending therefrom onto which a guiderail is secured.

Finally, a synthetic spacer block and metallic support posts are illustrated in U.S. Pat. No. 6,007,269 in which a metal post of a cross-sectionally I-beam configuration has a monolithic spacer block attached thereto. The spacer block is made of a composite recyclable synthetic resin material and is formed to be in registration with the surface of the I-beam support posts.

SUMMARY OF THE INVENTION

A guiderail support post having a one-piece configuration to be driven into the ground with a vertically offset portion onto which a guiderail can be attached. The post is preferably made of a metal stamping having a cross-sectionally U-shaped configuration with elongated spaced parallel reinforcing flanges. The integral offset portion of the post is apertured to receive mounting fasteners onto which a guiderail is directly attached thereto.

DESCRIPTION OF THE DRAWINGS

FIG. 6 is a top plan view of a first alternate form of the guiderail post configuration;

FIG. 7 is a top plan view of a second alternate post configuration of the invention;

FIG. 8 is a side elevational view of a third alternate guiderail post configuration;

FIG. 9 is a top plan view of FIG. 8;

FIG. 10 is a partial top plan view of an alternate post configuration of the post shown in FIG. 8;

FIG. 11 is a partial side elevational view of a fourth alternate post configuration;

FIG. 12 is a partial front elevational view of the alternate post illustrated in FIG. 11; and FIG. 13 is a top plan view of the alternate post shown in FIG. 12.

DESCRIPTION OF THE PREFERRED EMBODIMENT

Figure 1:
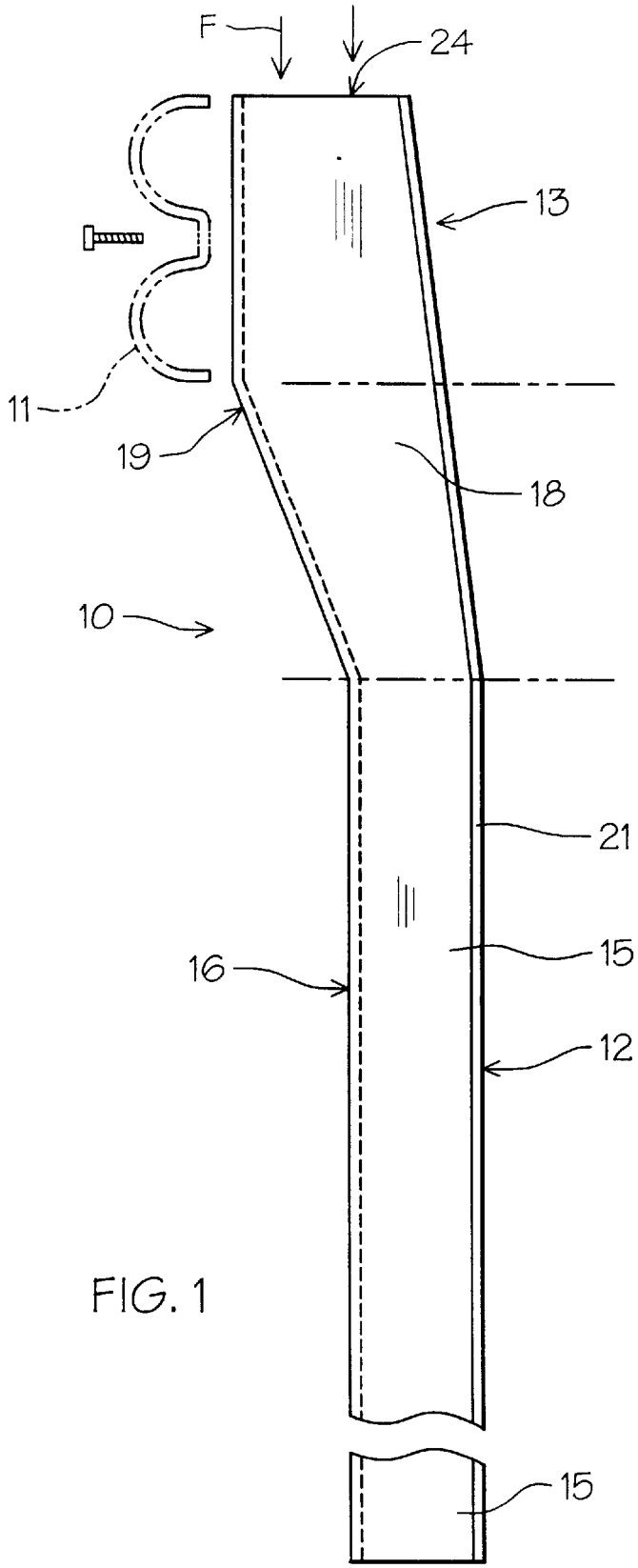
FIG. 1 is a side elevational view of the guiderail post of the invention with portions broken away.
Figure 2:
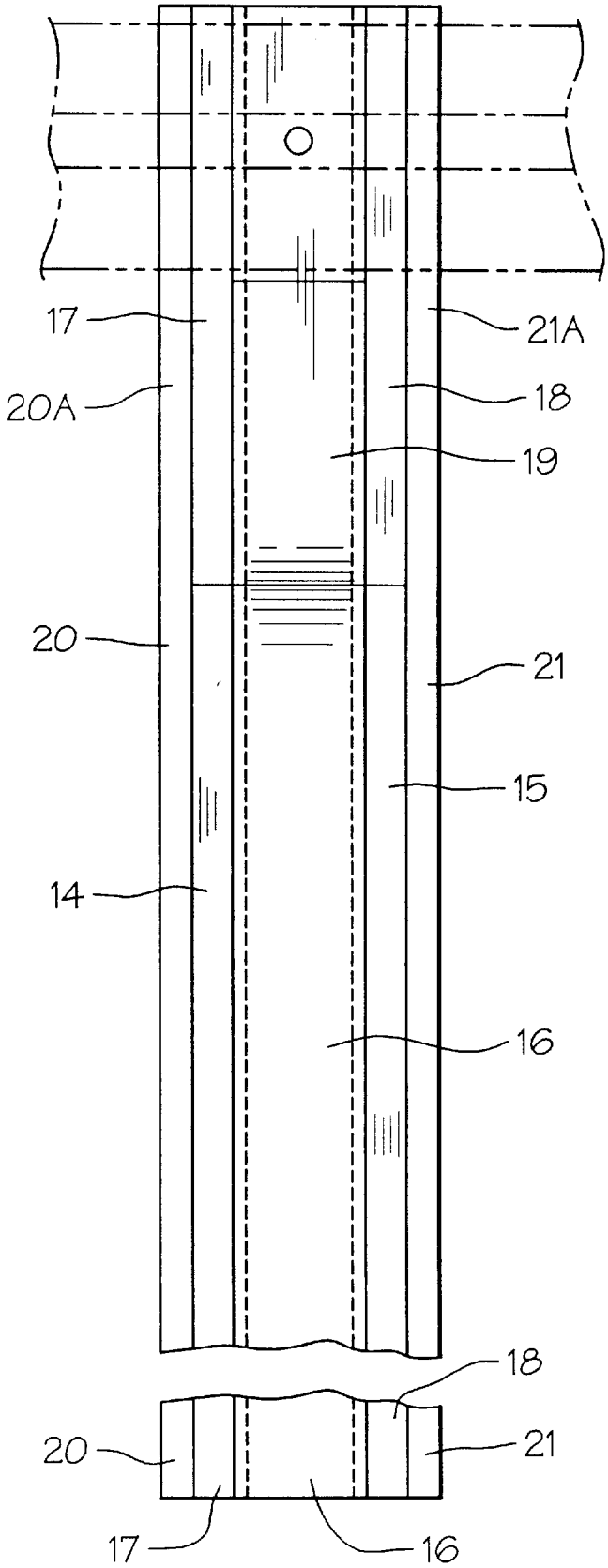
FIG. 2 is a front elevational view of the guiderail post with portions broken away.

Referring to FIGS. 1–5 of the drawings, a guiderail post 10 of the invention can be seen for use in supporting a horizontal guiderail 11 shown in broken lines in FIGS. 1 and 2 of the drawings. Such guiderails 11 are commonly used along highways to protect vehicles from severe damage by coming in contact with roadside objects and vehicles.

The guiderail post 10 has a main support leg portion 12 and a rail-mounting portion 13. The leg portion 12 has a cross-sectionally generally U-shaped configuration with elongated sidewalls 14 and 15 interconnected by a frontal surface wall 16. Correspondingly, the upper rail support portion 13 has an elongated oppositely disposed sidewalls 17 and 18 and interconnected front surface wall 19. In the preferred form of the invention the respective sidewalls 14 & 15 and 17 & 18 are tapered towards one another to their point of integral transition and engagement with the interconnecting frontal surface walls 16–19 respectively, best seen in FIGS. 4 and 5 of the drawings. Both the leg and post support portions 12 and 13 respectively have elongated continuous right angle flanges 20 and 21 extending along and from their respective free edges 18.

The sidewalls 14 and 15 are of a uniform transverse dimension along their length. Correspondingly, the sidewalls 17 and 18 of the upper rail support portion 13 are of an increasing transverse dimension from a broken line indicated at 17A to transition broken line indicator at 18A, best seen in FIGS. 1–3 of the drawings. The portions 20A and 21A of the right angle flanges 20 and 21 are tapered towards the front surface wall 19. It will be evident from the above description that a portion of the upper frontal wall surface 19 is angularly inclined at 23 from vertical orientation defining a transition between the lower frontal surface wall 16 and the upper frontal surface wall 19 which is in vertically spaced parallel relation to one another.

Due to the horizontal offset nature of the rail-mounting portion 13, a portion of an impact surface at 24 overlies the leg portion 12. This is important since during installation of the post 10 is typically driven into the ground by the application of vertical impact form upon the impact surface 24 indicated by the force arrows F.

Referring now to FIGS. 6 and 7 of the drawings, two alternate cross-sectional forms of the invention are shown. FIG. 6 illustrates a form 24 in which an alternate frontal surface wall is illustrated having a continuous curve surface 25 between respective sidewalls 26 and 27.

In FIG. 7 of the drawings, a second alternate cross-sectional configuration 28 can be seen wherein a modified frontal surface wall 29 is at true right angles to respective sidewalls 30 and 31.

A fourth alternate form of the guiderail post 10 can be seen in FIGS. 8, 9 and 10 of the drawings in which a post 32 has a leg portion 33 and a horizontally offset rail engagement portion 34. Both post and leg portions 33 and 34 are of an identical generally U-shaped cross-sectional configuration with interconnecting sidewalls 35 and 36 of equal transverse dimension.

The modified post configuration 32 has an angular transition portion 37 with equal transverse dimension to respective sidewalls 35 and 36. Such offset configuration require that the upper vertical rail portion 34 of the upper portion 32 be totally horizontally offset in regards to the vertical axis of the hereinbefore-described post portion 33.

Referring now to FIGS. 11–13 of the drawings, a further alternate form of the invention can be seen wherein an alternate guiderail post 37 is illustrated having leg portion 38 and an angular offset rail support portion 39. In this embodiment a frontal wall surface 40 has a single sidewall 41 extending at right angles interconnecting with a back support wall 42 in parallel spaced relation to said frontal wall 40. An angular inclined portion 43 of the frontal wall 40 defines the horizontal offset of an apertured rail mounting surface portion 44 of the frontal wall 40. A tri-guiderail 45, shown in broken lines can be secured there to. It will be evident to those skilled in the art that all forms of the invention are proportioned to accept either a typical two-rail guiderail as illustrated in FIG. 1 or the tri-three guiderail shown in broken lines in FIG. 11, for example. The back support wall 42 is of a greater transverse dimension then that of the frontal surface 40 and therefore defines a cross-sectionally L-shaped post with a right angle return defined by the frontal wall 40 as best seen in FIG. 13 of the drawings.

Figure 3:
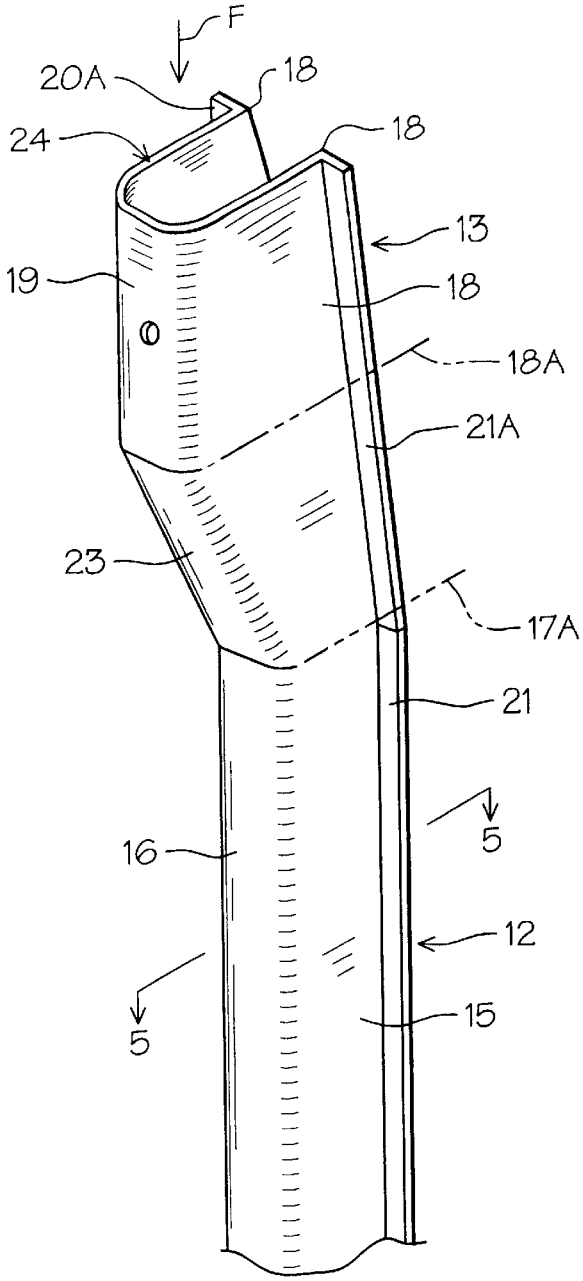
FIG. 3 is a perspective view of the guiderail post with portions broken away.
Figure 4:
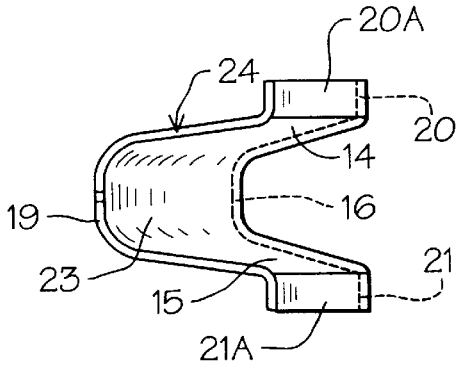
FIG. 4 is a top plan view of the guiderail post.
Figure 5:
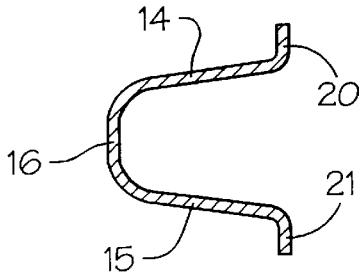
FIG. 5 is a cross-section on line 5—5 of FIG. 3.

The nature and degree of horizontal offset is the same as that set forth in the primary form of the invention illustrated in FIGS. 1–3 so that the same application of driving force F can be applied to secure the alternate post 37 into the ground as hereinbefore described.

It will be evident from the above descriptions that the primary and alternate forms of the guiderail post 10 of the invention provides a unique integral monolithic structure that incorporates the advantages of a metal rail with a single one-piece offset portion onto which the guiderail is secured.

It will thus be seen that a new and useful guiderail post has been illustrated and described and it will be evident to those skilled in the art that various changes and modifications may be made thereto without departing from the spirit of the invention.

Therefore I claim:

1. A guiderail post for supporting a highway guiderail comprising, an elongated monolithic contoured post member formed of a single sheet of metallic material, the post member having a leg portion and a rail engagement portion, said leg and rail engagement portions having oppositely disposed spaced common sidewalls with interconnected common frontal wall surface extending there between, the rail engagement portion being horizontally offset in relation to said leg portion.

2. The guiderail post set forth in claim 1 wherein said vertical offset rail engagement portion overlies a portion of said leg portion so as to transfer vertical load imparted thereon to said leg portion.

3. The guiderail post set forth in claim 1 wherein said oppositely disposed sidewalls have elongated right angled flanges along their respective free edges in spaced relation to said frontal surface wall.

4. The guiderail post set forth in claim 1 wherein said oppositely disposed sidewalls are angularly inclined towards one another.

5. The guiderail post set forth in claim 1 wherein said frontal surface wall comprises a pair of longitudinally spaced horizontally offset vertically oriented wall surfaces and an interconnecting angularly disposed frontal wall surface there between.

6. The guiderail post set forth in claim 1 wherein said sidewalls of said leg support portion are of a known transverse dimension and said sidewalls of said rail support portion are of a transverse dimension greater than that of said leg support port sidewalls known dimension.

7. A guiderail post for supporting a highway guiderail comprises, an elongated monolithic contoured post member formed from a single sheet of metallic material, said post member having a leg portion and a rail engagement portion, said leg portion having an elongated sidewall, a back wall and a pair of longitudinally spaced horizontally offset vertical oriented frontal wall surfaces and interconnecting angularly disposed frontal wall surface there between, said frontal wall surfaces are of a known transverse dimension and said back wall is of a transverse dimension greater than that of said frontal wall surfaces, said rail engagement portion being horizontally offset in relation to said leg portion.

* * * * *